United States Patent [19]

O'Brien

[11] 4,224,910

[45] Sep. 30, 1980

[54] CLOSED LOOP FUEL CONTROL SYSTEM WITH AIR/FUEL SENSOR VOTING LOGIC

[75] Inventor: Daniel J. O'Brien, Grand Blanc, Mich.

[73] Assignee: General Motors Corporation, Detroit, Mich.

[21] Appl. No.: 28,694

[22] Filed: Apr. 10, 1979

[51] Int. Cl.[3] ..... F02B 3/00; F02M 7/00

[52] U.S. Cl. ..... 123/440; 123/489

[58] Field of Search ..... 123/32 EE, 119 EC; 60/276, 285

[56] References Cited

U.S. PATENT DOCUMENTS 4,111,171 9/1978 Aono ..... 123/32 EE

*Primary Examiner*—Ronald B. Cox

*Attorney, Agent, or Firm*—Howard N. Conkey

[57] ABSTRACT

In a closed loop air and fuel ratio controller for an engine, an air/fuel sensor is responsive to the engine exhaust gases to provide a signal representing the air/fuel ratio of the mixture supplied to the engine. The output of the sensor is sampled N times during each of successive sampling periods and the number of samples indicative of a rich mixture versus the number of samples indicative of a lean mixture is utilized to provide an output representing a rich or lean error input to the closed loop controller.

4 Claims, 5 Drawing Figures

CLOSED LOOP FUEL CONTROL SYSTEM WITH AIR/FUEL SENSOR VOTING LOGIC

This invention relates to a closed loop air/fuel ratio controller for use with an internal combustion engine. More specifically, this invention relates to a closed loop controller including an apparatus and method for providing an indication of a rich or lean air/fuel ratio in response to a plurality of samples of the output of an air/fuel ratio sensor.

Closed loop air and fuel ratio controllers for adjusting the mixture of the fuel and air supplied to an internal combustion engine to obtain a predetermined ratio generally respond to a signal indicative of the sense of deviation of the sensed air/fuel ratio from the predetermined ratio and adjust the mixture in direction tending to restore the predetermined ratio. Generally, when the sense of deviation of the sensed air/fuel ratio changes, the closed loop controller reverses the direction of adjustment in order to again restore the supplied air/fuel ratio to the predetermined ratio. If these systems are of the type wherein the sensing of the air/fuel ratio and control in response thereto are done on a cyclic basis such as in a digital computer, the determining of the sense of direction of adjustment of the air/fuel ratio in response to a single sampling of the output of the air/fuel sensor may result in an erroneous correction. For example, the single sample may be made at a time when the air/fuel ratio is experiencing a momentary excursion through the predetermined desired ratio resulting in an erroneous indication of the overall sense of deviation of the air/fuel ratio from the predetermined ratio.

Accordingly, it is the general object of this invention to provide for an improved apparatus and method for determining the sense of deviation of the air/fuel ratio from a predetermined ratio in a system where the output of an air/fuel ratio sensor is periodically sampled.

It is another object of this invention to provide a system for indicating the sense of deviation of the air/fuel ratio from a predetermined ratio in a closed loop air/fuel ratio controller that is based on a plurality of samples of the output condition of the air/fuel sensor.

The invention may be best understood by reference to the following description of a preferred embodiment and the drawings in which.

Figure 1:
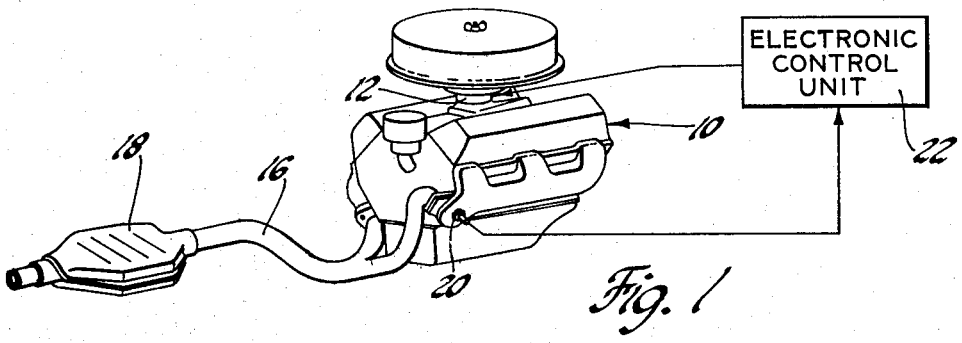
FIG. 1 illustrates an internal combustion engine incorporating a control system for controlling the air/fuel ratio of the mixture supplied to the engine in accord with this invention.

Referring to FIG. 1, an internal combustion engine 10 is supplied with a controlled mixture of fuel and air by a carburetor 12. The air and fuel mixture forms a combustible mixture that is drawn into the engine intake manifold and thereafter into respective cylinders and burned. The combustion byproducts from the engine 10 are exhausted to the atmosphere through an exhaust conduit 16 which includes a three-way catalytic converter 18 which simultaneously converts carbon monoxide, hydrocarbons and nitrogen oxides if the air/fuel mixture supplied thereto is maintained near the stoichiometric value.

It is difficult to provide a carburetor which has the desired response to the fuel determining input parameters over the full range of engine operating conditions. Additionally, these systems are generally incapable of compensating for various ambient conditions and fuel variations, particularly to the degree required in order to maintain the air/fuel mixture within the required narrow range at stoichiometry to obtain three-way catalytic conversion. Consequently, the air/fuel ratio provided by the carburetor 12 in response to its fuel determining input parameters may deviate from stoichiometry during engine operation.

To provide for the control of the air/fuel ratio of the mixture supplied by the carburetor 12 to the engine 10 so as to obtain the desired conversion characteristics, an air/fuel ratio sensor 20 is provided that senses the oxidizing/reducing condition of the exhaust gases upstream from the catalytic converter 18 and which is representative of the air/fuel ratio of the mixture supplied by the carburetor 12.

As illustrated in FIG. 1, the air/fuel ratio sensor 20 is positioned at the discharge point of one of the exhaust manifolds of the engine 10 and senses the exhaust discharged therefrom. The sensor 20 is preferably of the zirconia type which generates an output voltage that achieves its maximum value when exposed to rich air/fuel mixtures and its minimum value when exposed to lean air/fuel mixtures. Additionally, the output voltage from the sensor 20 exhibits an abrupt change between the high and low values as the air/fuel ratio of the mixture passes through the stoichiometric value.

The output of the sensor 20 is coupled to the input of an electronic control unit 22 which responds thereto and generates a closed loop control signal including integral and proportional terms that varies in amount and sense tending to restore the air/fuel ratio of the mixture supplied to the engine 10 by the carburetor 12 to the desired air/fuel ratio which, in the present embodiment, is the stoichiometric value. The carburetor 12 includes an air/fuel ratio adjustment device that is responsive to the control signal output of the electronic control unit 22 to adjust the air/fuel ratio of the mixture supplied by the carburetor 12.

In this embodiment, the control signal output of the electronic control unit 22 takes the form of a pulse width modulated signal at a constant frequency thereby forming a duty cycle modulated control signal. The pulse width of the signal output of the electronic control unit 22 is varied in response to the sensor 20 signal and in accord with both proportional and integral terms in the form of step and ramp functions to provide for variable duty cycle closed loop control of the carburetor 12. The duty cycle modulated signal output of the electronic control unit 22 is coupled to the carburetor 12 to effect the adjustment of the air/fuel ratio supplied by the fuel metering circuits therein. In this respect, a low duty cycle output of the electronic control unit 22 provides for an enrichment of the mixture supplied by the carburetor 12 while a high duty cycle value is effective to provide a lean air/fuel ratio adjustment.

An example of a carburetor 12 with a controller responsive to a duty cycle signal for adjusting the mixture supplied by both the idle and main fuel metering circuits is illustrated in the U.S. patent application Ser. No. 869,454, filed Jan. 16, 1978, which is assigned to the assignee of this invention. In this form of carburetor, the duty cycle modulated control signal is applied to a solenoid which simultaneously adjusts elements in the idle and main fuel metering circuits to provide for air/fuel ratio adjustments.

In general, the duty cycle of the output signal of the electronic control unit 22 may vary between 5% and 95% with an increasing duty cycle effecting a decreasing fuel flow to increase the air/fuel ratio and a decreasing duty cycle effecting an increase in fuel flow to decrease the air/fuel ratio. The range of duty cycle from 5% to 95% may represent the change in four air/fuel ratios at the carburetor 12 of FIG. 1.

Figure 2:
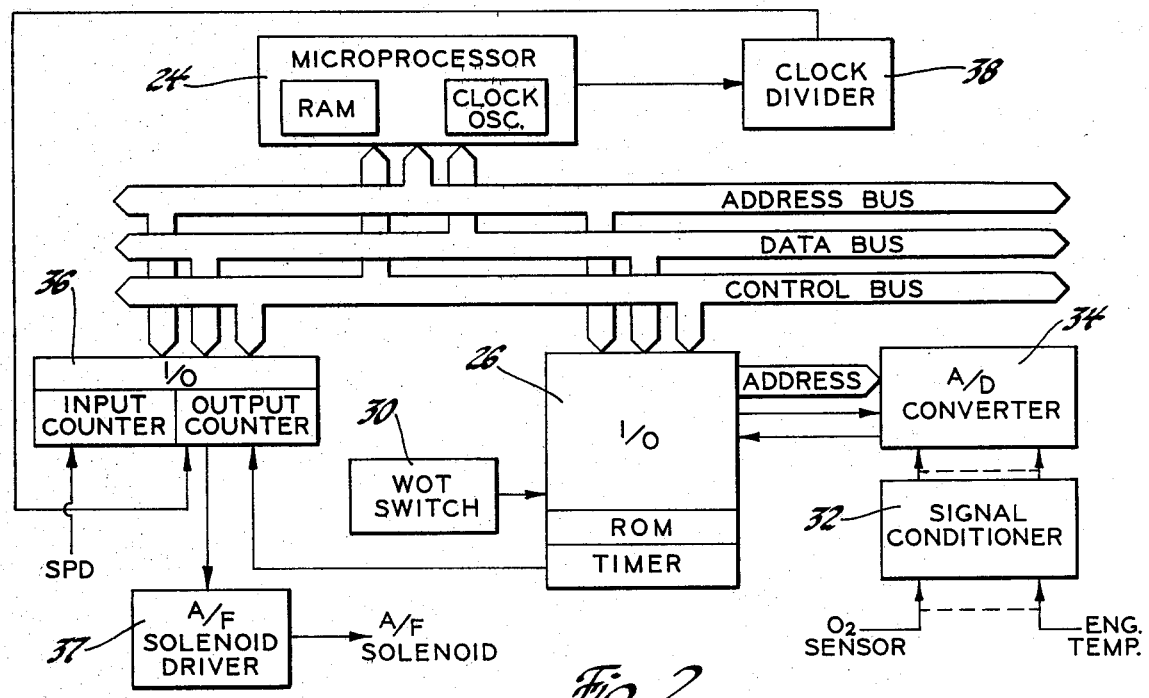
FIG. 2 illustrates a digital computer for controlling the air and fuel ratio of the mixture supplied to the engine of FIG. 1 in response to repeated samplings of an air/fuel ratio sensor in accord with the principles of this invention.

Referring to FIG. 2, the electronic control unit 22 in the present embodiment takes the form of a digital computer that outputs a pulse width modulated signal at a constant frequency to the carburetor to effect adjustment of the air/fuel ratio. The electronic control unit 22 determines whether the air/fuel ratio as sensed by the air/fuel sensor 20 is rich or lean in accord with the principles of this invention and adjusts the pulse width (duty cycle) in direction tending to restore the predetermined air/fuel ratio such as stoichiometry.

The digital system includes a microprocessor 24 that controls the operation of the carburetor 12 by executing an operating program which is stored in an external read-only memory (ROM). The microprocessor 24 may take the form of a combination module which includes a random access memory (RAM) and a clock oscillator in addition to the conventional counters, registers, accumulators, etc., such as a Motorola microprocessor MC6802. Alternatively, the microprocessor 24 may take the form of a microprocessor utilizing an external RAM and clock oscillator.

The microprocessor 24 controls the carburetor 12 by executing an operating program stored in a ROM section of a combination module 26. The combination module 26 also includes an input/output interface and a programmable timer. The combination module 26 may take the form of a Motorola MC6846 combination module. Alternatively, the digital system may include separate input/output interface modules in addition to an external ROM and timer.

The input conditions upon which the control of air/fuel ratio are based are provided to the input/output interface of the combination circuit 26. The discrete inputs such as the output of a wide open throttle switch 30 are coupled to discrete inputs of the input/output interface of the combination circuit 26. The analog signals such as the output of the air/fuel sensor 20 and engine temperature are provided to a signal conditioner 32 whose outputs are coupled to an analog-to-digital converter multiplexer 34. The particular analog condition to be sampled and converted is controlled by the microprocessor 24 via the address lines from the input-/output interface of the combination circuit 26. Upon command, the addressed condition is converted to digital form and supplied to the input/output interface of the combination circuit 26.

The duty cycle modulated output of the digital system for controlling the air/fuel solenoid in the carburetor 12 is provided by a conventional input/output interface circuit 36 which includes an output counter for providing the output pulses to the carburetor 12 via an air/fuel solenoid driver circuit 37. The output counter of the input/output interface circuit 36 receives a clock signal from a clock divider 38 and a 10 hz. signal from the timer in the combination circuit 26.

The microprocessor 24, the combination module 26 and the input/output interface circuit 36 are interconnected by an address bus, a data bus and a control bus. The microprocessor 24 accesses the various circuits and memory locations in the ROM via the address bus. Information is transmitted between the circuits via the data bus and the control bus includes lines such as read-write lines, reset lines, clock lines, etc.

As previously indicated, the microprocessor 24 reads data and controls the operation of the closed loop carburetor 12 by execution of its operating program as provided by the ROM in the combination circuit 26. Under control of the program, various input signals are read and stored in designated locations in the RAM in the microprocessor 24 and the calculations are performed for controlling the air/fuel ratio. The determined pulse width or duty cycle value for controlling the carburetor 12 is outputted via the input/output circuit 36.

Figure 3:
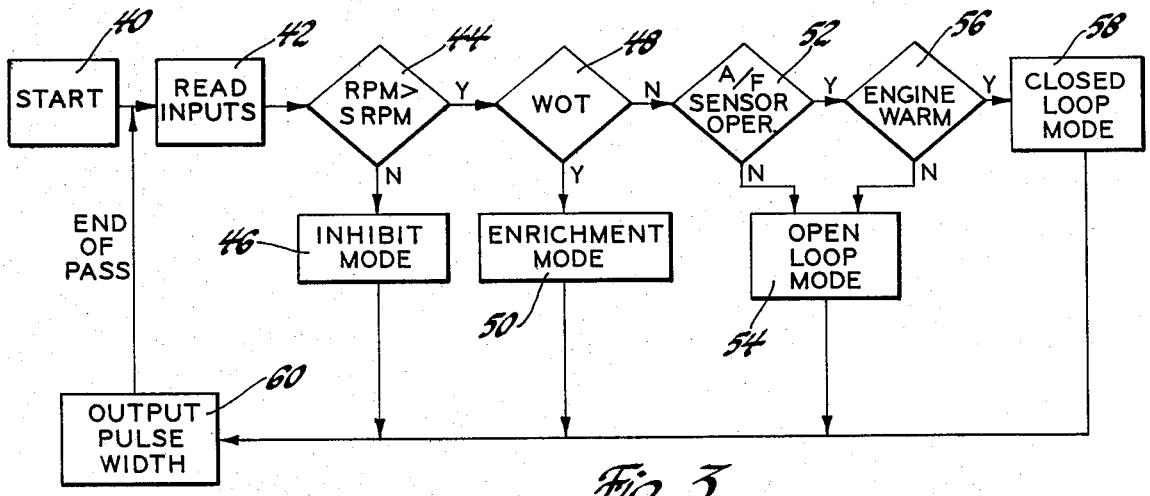
FIGS. 3, 4 and 5 are flow diagrams illustrative of the operation of the digital computer of FIG. 2 in accord with the principles of this invention.

Referring to FIG. 3, there is illustrated the major loop portion of the computer program. The major loop is entered at point 40 and is reexecuted every 100 milliseconds which is at the desired frequency of the pulse width modulated signal supplied to the carburetor 12. This frequency is determined by the timer portion of the combination module 26. At step 42 in the program, the computer executes a read routine wherein the discrete inputs, such as from the wide-open throttle switch 30, are stored in respective memory locations in the RAM, engine speed as determined via the input counter of the input/output circuit 36 is stored at a respective storage location in the RAM, and the various inputs to the analog-to-digital converter including the engine temperature signal are one by one converted by the analog-to-digital converter multiplexer 34 into a binary number representative of the value of the analog signal. These signals are read into respective storage locations in the RAM.

The computer program then proceeds to step 44 where engine speed as determined by the input counter section of the input/output circuit 36 is compared with a reference engine speed value SRPM that is less than the engine idle speed but greater than the cranking speed. If the engine speed is not greater than the reference speed SRPM, the program proceeds to an inhibit mode operation at point 46 wherein the width of the pulse width modulated signal for controlling the carburetor is set essentially to zero to thereby produce a zero % duty cycle signal for setting the carburetor to a rich setting to assist in vehicle engine starting. If the engine speed is greater than the reference speed SRPM indicating the engine is running, the major loop program cycle proceeds to decision point 48 where the computer determines whether the engine is operating at wide-open throttle thereby requiring power enrichment. This is accomplished by addressing the address location in the RAM at which the condition of the wide-open throttle switch 30 was stored during step 42. If the engine is at wide-open throttle, the program cycle proceeds to step 50 at which an enrichment routine is executed wherein the width of the pulse width modulated signal required to control the carburetor 12 for power enrichment is determined.

If the wide-open throttle condition for power enrichment is not present, the major loop program proceeds to decision point 52 where the operational condition of the air/fuel ratio sensor 20 is determined. In this respect, the system may determine operation of the sensor 20 by parameters such as elapsed time from system power up, sensor temperature or sensor impedance. If the air/fuel sensor 20 is determined to be inoperative, the program proceeds to step 54 at which an open loop routine is executed where an open loop pulse width is determined in accord with input parameters which may include the engine temperature read and stored in the RAM at program step 42. If the air/fuel ratio sensor 20 is operational, the major loop program proceeds to decision point 56 at which the computer determines whether the engine temperature stored in the RAM at step 42 is greater than a predetermined value. If the temperature of the engine is below this value, the computer program proceeds to step 54 and executes the open loop routine as previously described.

If the engine temperature is greater than the predetermined level, all of the conditions exist for closed loop control of the air/fuel ratio and the major loop program proceeds to step 58 where the computer executes a closed loop routine to determine the carburetor control signal pulse width in accord with the sensed air/fuel ratio.

From each of the program steps 46, 50, 54 and 58, the program cycle proceeds to step 60 at which the determined output pulse width in the form of a binary number is entered into the output counter of the input/output circuit 36. A pulse is then issued to the driver circuit 37 by the input/output circuit 36 having a duration determined by the number in the output counter and the clock frequency from the divider 38. The pulse width in conjunction with the computer program cycle rate (10 hz. in this embodiment) defines the variable duty cycle control signal for controlling the carburetor 12.

Assuming the conditions are such that the inhibit mode, enrichment mode and open loop mode are bypassed during each major loop cycle, the closed loop mode routine is executed each 100 milliseconds since the major loop program is executed at a 10 hz. rate. The closed loop routine executed at step 58 in the major loop cycle of FIG. 3 is illustrated in FIG. 5.

Figure 5:
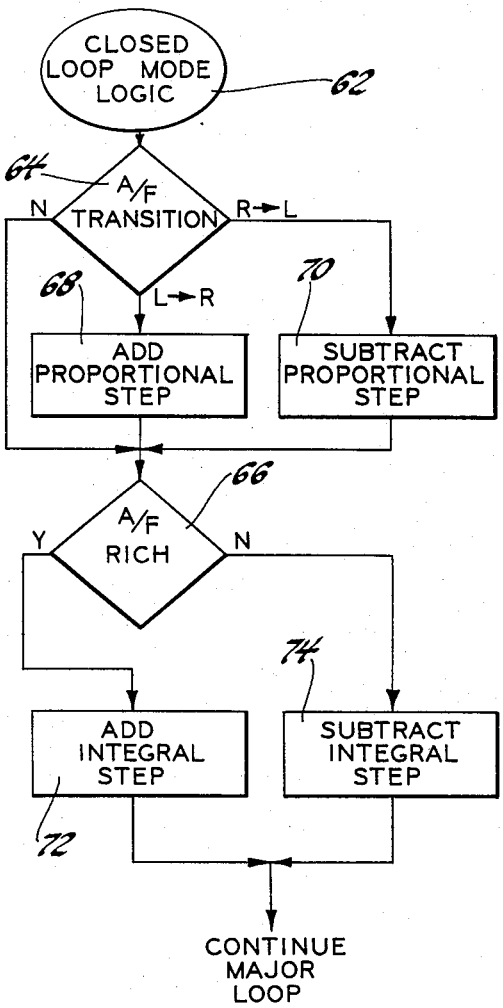

Referring to FIG. 5, there is illustrated a diagram of the program steps performed at step 58 in the major loop cycle. At step 62, the program cycle enters the closed loop mode and then proceeds to decision point 64 where the present rich-lean state of the air/fuel ratio is compared with the rich-lean state of the air/fuel ratio during the prior major loop cycle to determine if there has been a transition in air/fuel ratio relative to stoichiometry. If a rich-lean transition in the air/fuel ratio has not occurred, only an integral term adjustment is required and the program cycle proceeds to decision point 66. If a lean-to-rich transition is detected, the program proceeds to step 68 wherein a predetermined proportional term value stored in the ROM is added to the previously calculated closed loop pulse width stored in the RAM to effect a proportional step increase in the calculated duty cycle of the carburetor control signal. If a rich-to-lean transition is detected, the program proceeds to step 70 wherein a predetermined proportional term value stored in the ROM is subtracted from the previously determined closed loop pulse width stored in the RAM to effect a proportional step decrease in the calculated duty cycle of the carburetor control signal.

From either of the steps 68 or 70, the program cycle proceeds to the decision point 66 where the state of the air/fuel ratio is sensed. If the air/fuel ratio is rich relative to stoichiometry, the program proceeds to step 72 where a predetermined integral step is added to the closed loop pulse width value stored in the RAM. If the air/fuel ratio is not rich relative to stoichiometry, a predetermined integral step is subtracted from the previously determined closed loop pulse width stored in the RAM. From the step 72 or 74, the program then continues the major loop wherein the determined closed loop pulse width is outputted at step 60 to the output counter in the input/output circuit 36 which provides for a pulse width to the carburetor 12 in accord with the determined closed loop value stored in the RAM. The closed loop routine of FIG. 5 is repeated at a 10 hz. rate resulting in an output duty cycle signal to the carburetor 12 that is comprised of proportional and integral correction terms in the form of step and ramp functions for adjusting the carburetor in direction tending to produce a stoichiometric mixture.

If at decision points 64 and 66 the rich or lean state of the air/fuel ratio were based on a single sampling of the output of the air/fuel sensor 20 during each major loop routine of FIG. 3, the resulting rich or lean decision may not be indicative of the actual sense of deviation of the air/fuel ratio from the stoichiometric value. For example, the oxidizing/reducing conditions in the exhaust gases sensed by the air/fuel ratio sensor 20 may experience momentary transients through the stoichiometric value. If the output of the sensor 20 were sampled at this time, the integral term correction and the proportional term correction if applicable may effect an adjustment of the closed loop duty cycle in a direction opposite to the direction required to restore the air/fuel ratio of the mixture supplied by the carburetor 12 to the stoichiometric value.

In order to alleviate the aforementioned condition, this invention provides for a number of samplings of the output of the air/fuel sensor 20 during the 100 millisecond period of the major loop cycle of FIG. 3. Based on these samples, the system then determines or "votes" as to whether the air/fuel ratio is to be indicated as rich or lean.

In this embodiment, the number of times N that the air/fuel sensor 20 output is sampled during each 100 millisecond major loop cycle of FIG. 3 is four. However, numbers such as 8 may be selected. If the majority of the samples of the sensor 20 output represents a rich air/fuel ratio, a rich vote is made and the closed loop routine of FIG. 5 operates based on a sensed rich air/fuel ratio. If the majority of the samples of the sensor 20 output represents a lean air/fuel ratio, a lean vote is made and the closed loop routine of FIG. 5 operates based upon a sensed lean air/fuel ratio. However, when the number of samples representing a lean mixture is equal to the number of samples representing a rich mixture, the rich or lean vote is made the opposite of the rich-lean vote made during the prior 100 millisecond period since due to the engine transport delay, the integral term of the closed loop duty cycle signal will have caused the air/fuel ratio of the mixture supplied by the carburetor 12 to overshoot the stoichiometric value.

Figure 4:
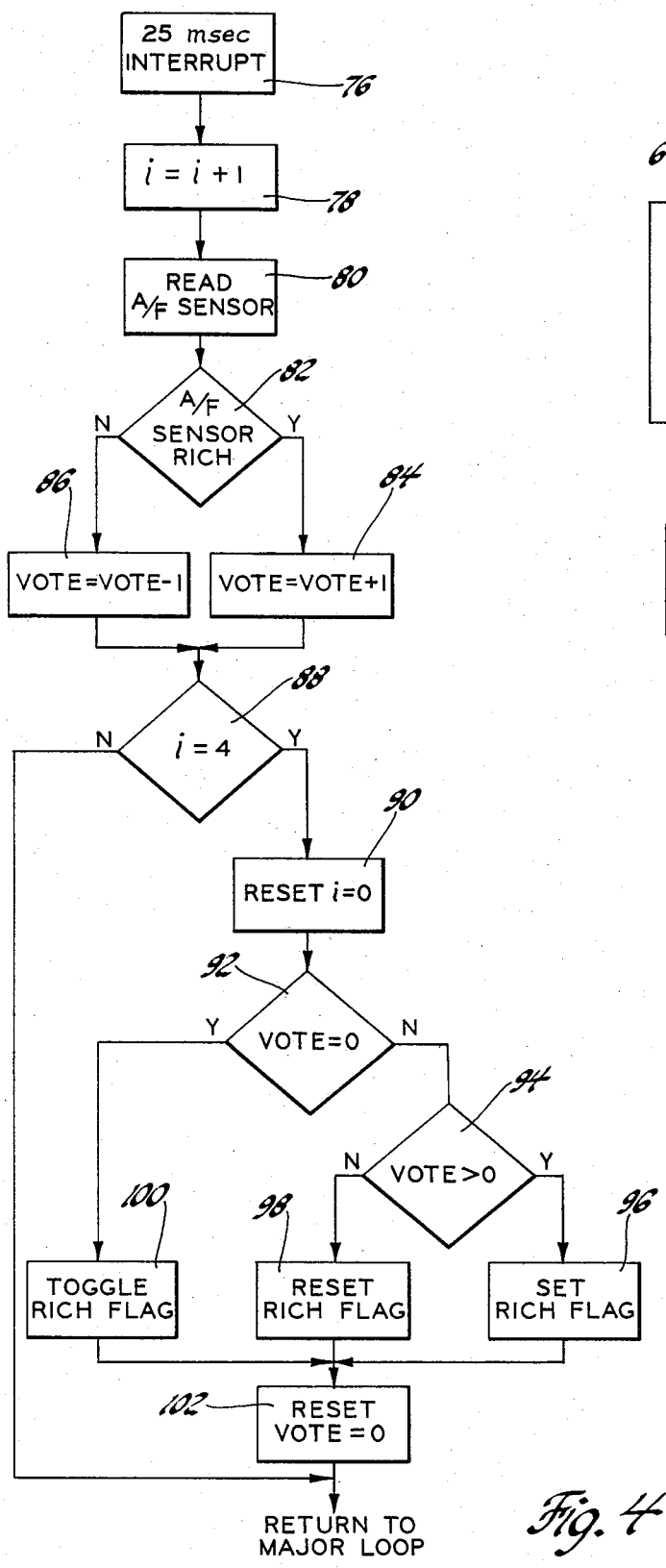

Referring to FIG. 4, there is illustrated the voting logic routine that is executed four times for each major loop cycle of FIG. 3 which is repeated every 100 milliseconds. The voting logic routine is executed by a minor loop program which is caused to be repeated every 25 milliseconds by a 25 millisecond interrupt signal provided by the microprocessor 24 which interrupts the major loop cycle of FIG. 3. Each 25 milliseconds, the interrupt is provided at step 76 to initiate the minor loop program which then proceeds to step 78 where an index number is incremented by one. This index number is initialized to zero at the beginning of each of repeated 100 millisecond periods and is representative of the number of times the minor loop program has been executed during a 100 millisecond period.

After increasing the index number by one, the minor loop program proceeds to step 80 where the output of the air/fuel sensor 20 is sampled via control of the analog-to-digital converter 34 and the input/output circuit 26. The minor loop program operates to compare the sampled sensor signal with a reference value representing a stoichiometric air/fuel ratio at decision point 82 to determine whether the sampled air/fuel ratio at step 80 is rich or lean. If the sampled sensor output represents a rich mixture, the program proceeds to step 84 where a voting logic number stored in a respective location in the RAM is incremented by one. However, if the sampled sensor voltage represents a lean air/fuel ratio, the program proceeds to step 86 wherein the voting logic number stored in the RAM location is decremented by one.

The voting logic number stored in the RAM and which is incremented or decremented in the steps 84 or 86 is an accumulation of the rich and lean samples at step 82 during the 100 millisecond sampling period. The voting logic number, hereinafter referred to as the vote, is initialized to zero, as will be described, at the beginning of each of repeated 100 millisecond sampling periods. Therefore, after the desired number of air/fuel sensor signal samples during each 100 millisecond period (4 in this embodiment), the vote is greater than zero if a majority of the sensor signal samples represents a rich air/fuel ratio relative to stoichiometry and is less than zero if a majority of the sensor signal samples represents a lean air/fuel ratio relative to stoichiometry. If the vote is equal to zero after the desired number of sensor signal samples, the number of samples representing rich and lean air/fuel ratios are divided equally and is indicative of a sensed stoichiometric mixture.

Following the steps 84 and 86, the program cycle proceeds to decision point 88 where the index number determined at step 78 is compared with the number N previously referred to and which represents the desired number of air/fuel sensor samples from which the decision as to the sense of deviation of the air/fuel ratio relative to stoichiometry is to be made. If the number is less than N, the vote is not yet based on the desired number of sensor signal samples and the program cycle then returns to the interrupted major loop which is then continued as previously described with reference to FIG. 3. However, if the index number determined at step 78 is equal to the number N, the vote is based on the desired number of sensor signal samples and the program proceeds to step 90 where the index number is reset to zero to begin the next 100 millisecond period at the next 25 millisecond minor loop interrupt.

The minor loop program then executes a voting logic routine to determine the air/fuel ratio as represented by the accumulated vote. The vote stored in the RAM at steps 84 or 86 is first compared to zero at decision point 92. If the vote is not equal to zero, the program proceeds to decision point 94 where it is determined whether the majority of the four sensor signal samples during the 100 millisecond sampling period represents a lean or a rich air/fuel ratio. If the vote is greater than zero, a majority of the samples of the sensor signal indicated a rich air/fuel ratio and the program proceeds to step 96 where a rich flag (a state of a respective memory location in the RAM) is set to indicate a sensed rich air/fuel ratio. However, if the accumulated vote is less than zero, a majority of the samples of the sensor signal indicated a lean air/fuel ratio and the program proceeds to step 98 where the rich flag in the RAM is reset to indicate a lean air/fuel ratio. If at step 92, the accumulated vote is equal to zero, representing the number of sensor signal samples representing a rich mixture being equal to the number of samples representing a lean mixture, the program cycle proceeds to step 100 where the rich flag in the RAM is toggled or reversed so as to represent an air/fuel ratio opposite to the air/fuel ratio represented by the rich flag at the end of the prior 100 millisecond sensor sampling period.

From the steps 96, 98 and 100, the minor loop program cycle proceeds to step 102 where the vote number is set to zero so that both the index number and vote are then initialized for the next 100 millisecond period. The program then returns to the interrupted major loop which is continued in accord with FIG. 3. During execution of the closed loop routine in the major loop, the state of the rich flag resulting from the four samples of the air/fuel sensor 20 output is used at steps 64 and 66 to provide for the closed loop adjustment of the carburetor 12.

The foregoing description of the invention for the purpose of illustrating the principles thereof is not to be considered as limiting or restricting the invention since many modifications may be made by the exercise of skill in the art without departing from the scope of the invention.

The embodiments of the invention in which an exclusive property or privilege is claimed are defined as follows:

1. A closed loop air and fuel ratio controller for an engine comprising, in combination:

supply means effective to supply a mixture of air and fuel to the engine;

sensor means effective to sense the air/fuel ratio of the mixture supplied to the engine and provide a sensor signal having a value representing the sensed air/fuel ratio;

an air/fuel ratio condition sensing means effective during each of successive sampling periods to provide an output representing the sense of deviation of the air/fuel ratio from a predetermined ratio, said air/fuel ratio condition sensing means including a memory element having two stable states, means effective during each sampling period to sample the value of the sensor signal N times, and means responsive to the N sampled sensor signals during each sampling period effective to (1) set the memory element to one of its stable states representing an air/fuel ratio greater than the predetermined ratio when more than N/2 samples of the sensor signal values represent an air/fuel ratio greater than the predetermined ratio and (2) set the memory element to the other one of its stable states representing an air/fuel ratio less than the predetermined ratio when less than N/2 samples of the sensor signal values represent an air/fuel ratio less than the predetermined ratio; and means responsive to the state of the memory element effective to adjust the air/fuel ratio of the mixture supplied by the supply means in amount and direction tending to produce the predetermined ratio.

2. A closed loop air and fuel ratio controller for an engine comprising, in combination:

supply means effective to supply a mixture of air and fuel to the engine;

sensor means effective to sense the air/fuel ratio of the mixture supplied to the engine and provide a sensor signal having a value representing the sensed air/fuel ratio;

an air/fuel ratio condition sensing means effective during each of successive sampling periods to provide an output representing the sense of deviation of the air/fuel ratio from a predetermined ratio, said air/fuel ratio condition sensing means including a memory element having two stable states, means effective during each sampling period to sample the value of the sensor signal N times wherein N is an even integer and means responsive to the sampled sensor signals during each sampling period effective to (1) set the memory element to one of its stable states representing an air/fuel ratio greater than the predetermined ratio when the number of sampled sensor signal values representing an air/fuel ratio greater than the predetermined ratio is greater than N/2, (2) set the memory element to the other one of its stable states representing an air/fuel ratio less than the predetermined ratio when the number of sampled sensor signal values representing an air/fuel ratio less than the predetermined ratio is greater than N/2 and (3) change the state of the memory element when the number of sampled sensor signal values representing an air/fuel ratio greater than the predetermined ratio is equal to the number of sampled sensor signal values representing an air/fuel ratio less than the predetermined ratio; and means responsive to the state of the memory element effective to adjust the air/fuel ratio of the mixture supplied by the supply means in amount and direction tending to produce the predetermined ratio.

3. A closed loop air and fuel ratio controller for an engine comprising, in combination:

supply means effective to supply a mixture of air and fuel to the engine;

sensor means effective to sense the air/fuel ratio of the mixture supplied to the engine and provide a sensor signal having a value representing the sensed air/fuel ratio;

an air/fuel ratio condition sensing means effective during each of successive sampling periods to provide an output representing the sense of deviation of the air/fuel ratio from a predetermined ratio, said air/fuel ratio condition sensing means including a memory element having two stable states, an accumulator having a predetermined number therein at the beginning of each sampling period, means effective during each sampling period to sample the value of the sensor signal N times, means effective to increase the number in the accumulator by one for each sampled value of the sensor signal representing an air/fuel ratio varying in one sense from the predetermined ratio and to decrease the number in the accumulator by one for each sampled value of the sensor signal representing an air/fuel ratio varying in an opposite sense from the predetermined ratio, and means responsive to the number in the accumulator at the end of each sampling period effective to (1) set the memory element to one of its stable states representing an air/fuel ratio varying in said one sense from the predetermined ratio when the number in the accumulator is greater than the predetermined number and (2) set the memory element to the other one of its stable states representing an air/fuel ratio varying in said opposite sense from the predetermined ratio when the number in the accumulator is less than the predetermined number; and means responsive to the state of the memory element effective to adjust the air/fuel ratio of the mixture supplied by the supply means in amount and direction tending to produce the predetermined ratio.

4. The method of controlling the air and fuel ratio of the mixture supplied to an engine comprising the steps of:

supplying a mixture of air and fuel to the engine;

sensing the air/fuel ratio of the mixture supplied to the engine and providing a sensor signal having a value representing the sensed air/fuel ratio;

sampling the value of the sensor signal N times during each of successive sampling periods;

setting a bistable memory element to one of its stable states representing an air/fuel ratio greater than a predetermined ratio when the number of sampled sensor signal values representing an air/fuel ratio greater than the predetermined ratio is greater than N/2;

setting the memory element to the other one of its stable states representing an air/fuel ratio less than the predetermined ratio when the number of sampled sensor signal values representing an air/fuel ratio less than the predetermined ratio is greater than N/2; and adjusting the air/fuel ratio of the mixture supplied by the supply means in direction in accord with the state of the memory element tending to produce the predetermined ratio.

* * * * *